US010561260B2

(12) United States Patent
Carroll et al.

(10) Patent No.: US 10,561,260 B2
(45) Date of Patent: Feb. 18, 2020

(54) SYSTEM FOR HOLDING TABLEWARE ON A TABLE

(71) Applicants: Jodi A Carroll, Winfield, IL (US); James Robert Carroll, Winfield, IL (US)

(72) Inventors: Jodi A Carroll, Winfield, IL (US); James Robert Carroll, Winfield, IL (US)

(73) Assignee: STAY-PUT SYSTEMS, LLC, Winfield, IL (US)

( * ) Notice: Subject to any disclaimer, the term of this patent is extended or adjusted under 35 U.S.C. 154(b) by 0 days.

(21) Appl. No.: 15/979,125

(22) Filed: May 14, 2018

(65) Prior Publication Data

US 2019/0133351 A1 May 9, 2019

Related U.S. Application Data

(60) Provisional application No. 62/518,142, filed on Jun. 12, 2017, provisional application No. 62/506,384, filed on May 15, 2017.

(51) Int. Cl.

| | |
|---|---|
| ***A47G 19/02*** | (2006.01) |
| ***A47G 19/10*** | (2006.01) |
| ***A47G 19/22*** | (2006.01) |

(52) U.S. Cl.

CPC ..... *A47G 19/02* (2013.01); *A47G 19/10* (2013.01); *A47G 19/22* (2013.01); *A47G 2200/106* (2013.01)

(58) Field of Classification Search

CPC ..... A47G 19/00–22; A47G 2200/00–106

See application file for complete search history.

(56) References Cited

U.S. PATENT DOCUMENTS

| | | | |
|---|---|---|---|
| 425,768 | A | 4/1890 | Ezell |
| 879,364 | A | 2/1908 | Cohen |
| 2,217,514 | A | 3/1938 | Henry |

(Continued)

OTHER PUBLICATIONS

Wikipedia, "Ferromagnetism", Mar. 9, 2017 (Mar. 9, 2017); retrieved on Jul. 26, 2018 from https://enwikipedia.org/w/index.php?title=Ferromagnetism&oldid=769451801;entire document, especially p. 1 para 1.

(Continued)

*Primary Examiner* — Kareen K Thomas

(74) *Attorney, Agent, or Firm* — Erickson Law Group, PC

(57) ABSTRACT

The invention provides a supported body having a magnetic or ferromagnetic component to adhere the supported body to a magnetic or ferromagnetic support, such as a table top by magnetic attraction. A reusable adhering component, such as a stretch-releasable pressure sensitive adhesive tape is disposed on a top surface of the supported body to removably attach tableware or dishware to the supported body. The supported body can be in the form of a plate, a coaster, a placemat, or other known configuration. Alternatively, a support body can be releasably secured to a table top or other support surface by a releasable attaching device such as a suction cup and a supported body can be releasably attached to a piece of tableware or dishware by a releasable attaching device such as a suction cup, and the support body and the supported body can be magnetically attached to each other.

22 Claims, 8 Drawing Sheets

(56) References Cited

U.S. PATENT DOCUMENTS

| | | | | |
|---|---|---|---|---|
| 3,013,688 | A | 10/1957 | Luning | |
| 3,285,456 | A | 11/1966 | Pewitt | |
| 3,524,614 | A | 8/1970 | Sorth | |
| 4,024,312 | A | 5/1977 | Korpman | |
| 5,031,874 | A | 7/1991 | Shannon | |
| 5,186,350 | A | 2/1993 | McBride | |
| 5,366,103 | A | 11/1994 | Abernathy et al. | |
| 5,516,581 | A | 5/1996 | Kreckel et al. | |
| 5,873,486 | A | 2/1999 | Morgan | |
| 6,001,471 | A | 12/1999 | Bries et al. | |
| 6,179,377 | B1 | 1/2001 | Harper | |
| 6,302,363 | B1 | 10/2001 | Olson et al. | |
| 6,305,656 | B1 | 10/2001 | Wemyss | |
| 6,572,945 | B2 | 6/2003 | Bries et al. | |
| 6,972,141 | B1 | 12/2005 | Bries et al. | |
| 7,600,486 | B2 | 10/2009 | Ellis | |
| 7,637,388 | B2 | 12/2009 | Schantz et al. | |
| 8,002,140 | B2 | 8/2011 | Schantz et al. | |
| 8,251,247 | B1 | 8/2012 | Breckner | |
| 8,302,806 | B1 | 11/2012 | Gibbar | |
| 8,334,037 | B2 | 12/2012 | Sheridan et al. | |
| 9,144,321 | B2 * | 9/2015 | Melo | A47D 1/008 |
| 2006/0207993 | A1 | 9/2006 | Copeland | |
| 2010/0176253 | A1 | 1/2010 | Son | |
| 2010/0154683 | A1 | 6/2010 | Royka | |
| 2011/0072978 | A1 * | 3/2011 | Popescu | A47G 19/14 99/288 |
| 2013/0098924 | A1 | 4/2013 | Tate | |
| 2013/0105492 | A1 | 5/2013 | Melgoza | |
| 2014/0299608 | A1 | 10/2014 | Melo | |
| 2014/0304953 | A1 | 10/2014 | Crosby et al. | |
| 2015/0001228 | A1 | 1/2015 | Rapp | |
| 2015/0173536 | A1 | 6/2015 | Frangione | |
| 2016/0058220 | A1 | 3/2016 | Dixon | |
| 2016/0249768 | A1 | 9/2016 | Casey et al. | |

OTHER PUBLICATIONS

PCT Notification of the International Search Report dated Sep. 4, 2018.

PCT Notification of Written Opinion dated Sep. 4, 2018.

* cited by examiner

SYSTEM FOR HOLDING TABLEWARE ON A TABLE

This application claims the benefit of U.S. Provisional Application Ser. No. 62/506,384, filed May 15, 2017; and U.S. Provisional Application Ser. No. 62/518,142, filed Jun. 12, 2017.

BACKGROUND

Systems for holding tableware to a table or support surface are known. Particularly, U.S. Pat. No. 425,768; and Published Applications US20130098924 and US20130105492, describe magnetic systems for holding tableware and drinking vessels to tables, particularly for holding these to the table in environments where external forces such as the rolling of a ship at sea or high winds during outdoor dining, would otherwise cause the tableware to be tipped over or thrown off the table.

The present inventor has recognized that it would be desirable to provide an improved system that held tableware to a table or support surface that is easy to use, easy to make compatible with existing dishes, that was flexible to make the dishes able be used in a microwave oven and cleaned in a dishwasher.

SUMMARY

The exemplary embodiments of the present invention provide a supported body having a magnetic or ferromagnetic component to adhere the support body to a magnetic or ferromagnetic support by magnetic attraction. A reusable adhering component is disposed on a top surface of the supported body to removably attach tableware or dishware to the supported body.

The supported body can be in the form of a plate, a coaster, a placemat, or other known configuration.

According to one embodiment, the reusable adhering component comprises stretch-releasable pressure sensitive adhesive tape. According to another embodiment, the reusable adhering component comprises double sided tape or hook and loop tapes adhered respectively to each of the support body and the item of tableware or dishware.

The illustrated embodiments of the invention provide a system for adhering tableware or dishware to a support such as a table, including a supported body having a magnetic or ferromagnetic component; the support having a magnetic or ferromagnetic component for attaching the supported body to the support by magnetic attraction; and a reusable adhering component arranged on the supported body on a top surface thereof. The magnetic or ferromagnetic component can be one or more magnets or a magnetic material. The magnetic material can be a planar article having magnetic particles within the planar article.

The adhering component can comprise a stretch-releasable pressure sensitive adhesive tape. The adhering component can alternatively comprise a double sided adhesive tape. The adhering component could alternatively comprise a hook and loop fastener with cooperating surfaces adhered to the supported body and the tableware or dishware.

The support surface can be provided by a conventional table, a floating table, a lap table, a placemat or other type support. The table, particularly in the case of a lap style or tray style table, can be configured to float in water and/or be securable to boat tables, jet tables, RV tables, patio tables, etc., in order to secure them in place.

The dishes or other tableware or dishware can be secured while in motion, to prevent tipping due to waves, wind, turbulence, or bumps.

According to the invention, the adhering component can be parted to separate an item of tableware or dishware from the supported body. Thus, if the item of tableware or dishware is composed of a microwave compatible material, the supported body, which has magnets or magnetic material thereon or therein (not microwavable), can be separated from the item of tableware or dishware so the item of tableware or dishware can be used to heat food in a microwave. Also, the supported body, which has magnets or magnetic material thereon or therein, can be separated from the item of tableware or dishware so the item of tableware or dishware can be washed more conveniently in a sink or dishwasher. Also, the adhering component can be compatible with existing tableware or dishware so a consumer would not be required to purchase custom tableware or dishware to use the system.

According to a further embodiment of the invention, a support body, such as a plate, placemat, coaster, or the like, is attached to a releasable and reusable attaching device, such as a suction cup, on a bottom side of the support body. The support body can be composed of a ferromagnetic material or a magnetic material. The support body can be rigid or flexible. The suction cup is readily attachable to a conventional table or other support surface. The suction cup can be releasable from the support surface by a button or lever, as is known. A supported body, such as a plate or coaster, is attached to a releasable and reusable attaching device, such as a suction cup, on a top side of the supported body. The supported body can be composed of a ferromagnetic material or a magnetic material, selected to be magnetically attracted to the support body. The supported body can be rigid or flexible. The suction cup is readily attachable to a dishware, such as saucers, plates, bowls, drinking glasses, cups, stemware, or other dishware. The suction cup can be releasable from the support surface by a button or lever, as is known. According to this embodiment, the support body can be releasably attached to a support surface. The supported body can be releasably attached to a piece of dishware. The supported body is then magnetically attached to the support body. The releasable attachments, such as the suction cups, have a holding strength that is greater than the magnetic attraction between the supported body and the support body. A user can readily lift a glass or other dishware, with the supported body attached, from the support body by overcoming the magnetic attraction.

According to this embodiment, a magnetic dish holding arrangement can be provided that is compatible with conventional tables, such as wooden tables, or other support surface and is compatible with conventional dishware. The releasable attachments, such as suction cups, can be completely separated from the support surface and the dishware to clean the dishware and the support surface independent of the support body or the supported body.

The support surface can be provided by a conventional table, a floating table, a lap table, a placemat or other type support. The table, particularly in the case of a lap style or tray style table, can be configured to float in water and/or be securable to boat tables, jet tables, RV tables, patio tables, etc., in order to secure them in place.

The dishes or other tableware or dishware can be secured while in motion, to prevent tipping due to waves, wind, turbulence, or bumps.

Numerous other advantages and features of the present invention will be become readily apparent from the following detailed description of the invention and the embodiments thereof, and from the accompanying drawings.

DETAILED DESCRIPTION

Figure 1:
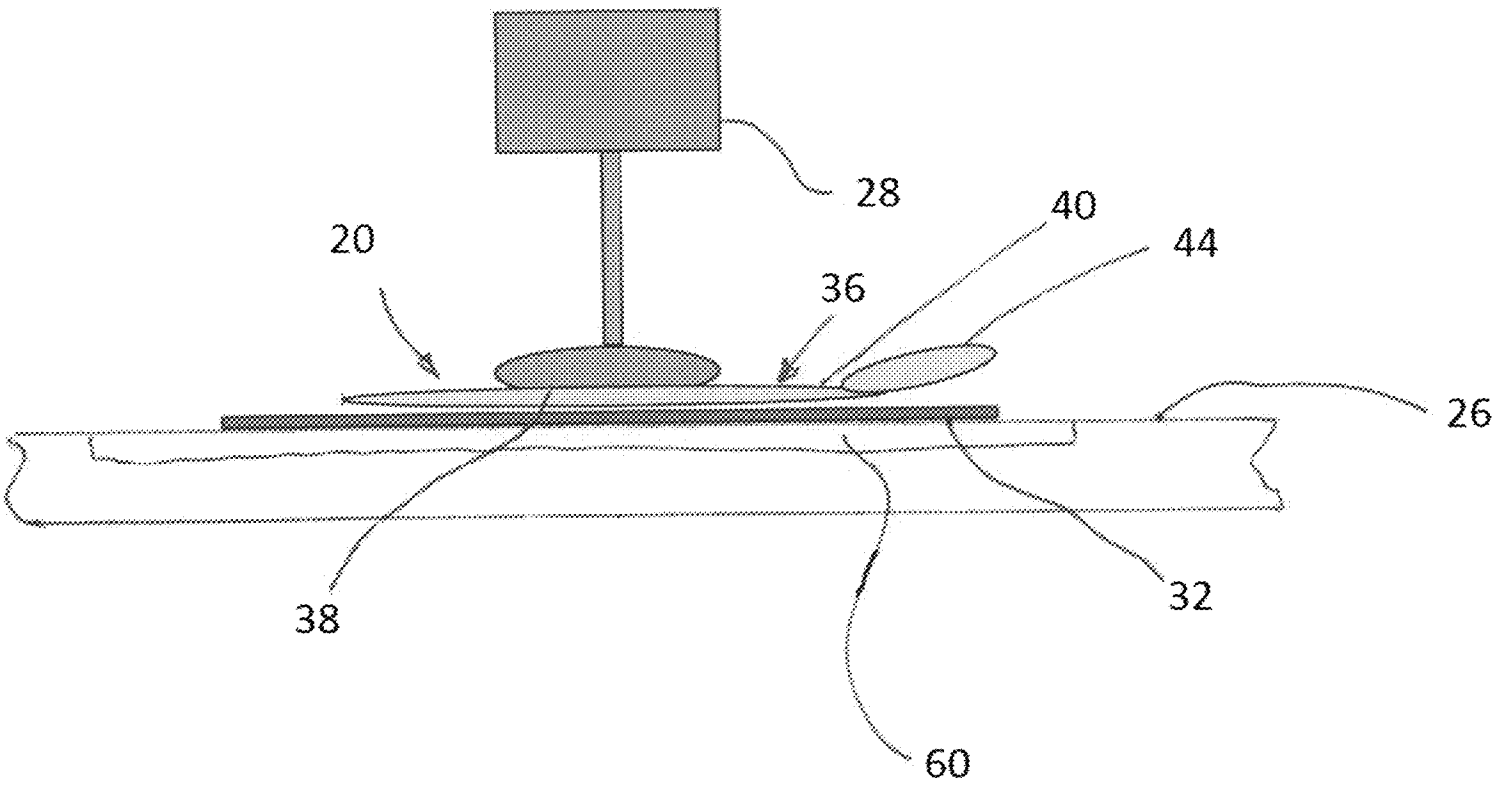
FIG. 1 is a schematic side view of a system according to the invention for holding tableware or dishware to a magnetic table or support surface.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

Figure 3:
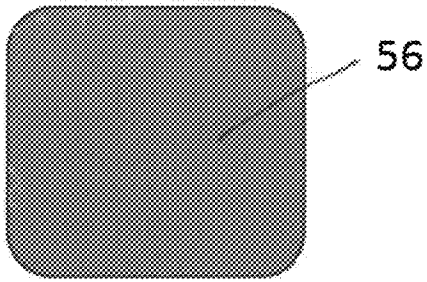
FIG. 3 is a plan view of the support shown in FIG. 2.
Figure 2:
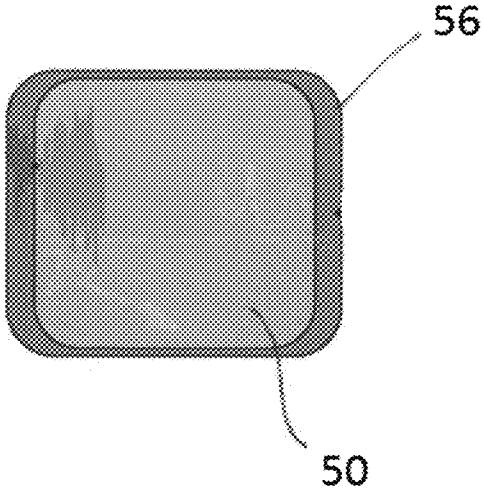
FIG. 2 is a bottom view of a support taken from FIG. 1.

FIG. 1 shows a system 20 for holding an item of tableware or dishware 28, such as a stemware glass, to a support surface such as a table 26. The system 20 includes a supported body 32 and an adhering component 36. The supported body 32 can be a flat, square shape as shown in FIGS. 2 and 3, or any other shape such as round. The supported body 32 can be rigid, flexible or soft. The table 26 can be a traditional table, a placemat, a lap table, a floating support, or other type support.

The adhering component 36 illustrated can be a reusable element such as one described in U.S. Pat. Nos. 8,334,037; 6,972,141; 6,572,945, all hereby incorporated by reference to the extent they are not inconsistent with the present disclosure. This type component includes an adhering body 40 attached to a pull tab 44.

The adhering component 36 can be a stretch-releasable pressure sensitive adhesive such as described in U.S. Pat. Nos. 4,024,312 and 5,516,581; and sold commercially as COMMAND by 3M Company, St. Paul, Minn., U.S., all of which are hereby incorporated by reference to the extent they are not inconsistent with the present disclosure.

Alternately, the adhering component 36 can comprise a mating pair of hook and loop tapes, other reusable double sided tapes, or other type of reusable adhering components.

The item of tableware or dishware 28 includes a bottom surface 38 that is arranged to be gripped by the adhering component 36. The tableware or dishware can be eating plates, dishes, saucers, drinking glasses, cups, bowls or any other tableware or dishware.

FIGS. 2 and 3 show the supported body 32 includes a magnetic component 50 and a supporting body portion 56. The magnetic component 50 can be inlaid into the supporting body portion 56 in order to provide a flush bottom surface to rest on a table top. The supporting body portion 56 can be rigid, flexible or soft.

The magnetic component 50 can be one or more individual magnets, or a magnetic flexible substrate, such as used in "refrigerator magnets" such as described in U.S. Pat. No. 6,302,363, hereby incorporated by reference to the extent it is not inconsistent with the present disclosure. The magnetic component 50 and the supporting body portion 56 can be a unitary article. The component 50 can be composed wholly of a flat relatively thin magnetized iron or steel sheet material or of a non-magnetic synthetic resinous plastic such as polystyrene, polypropylene, acrylic, or the like, having finely divided magnetic particles distributed throughout the component 50. Alternatively, the magnetic component 50 can be formed by a magnetic coating applied to a similar non-magnetic body.

In use, when a user wishes to lift the tableware or dishware off the table, for example to drink from the stemware glass, the supported body 32, in the form of a coaster, can be separated from the table and lifted still attached by the adhering component. Advantageously the plan view size of the coaster is about the same plan view size of the base of the stemware.

Figure 4:
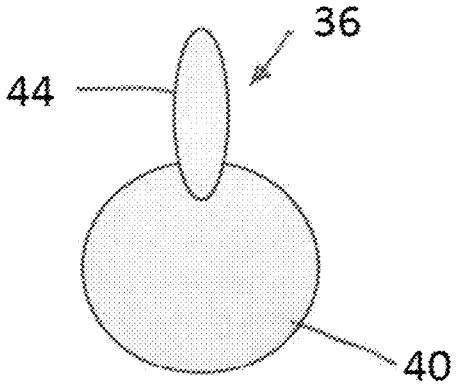
FIG. 4 is a schematic plan view of an adhering component taken from FIG. 1.

FIG. 4 illustrates the adhering component 36 having a round adhering body 40 and an elongated pull tab 44. The pull tab 44 extends out from between the tableware or dishware adhered to the supported body 32, and the supported body 32 so a user can separate the tableware or dishware from the supported body 32. The invention encompasses other shapes of the body 40 and tab 44.

Figure 5:
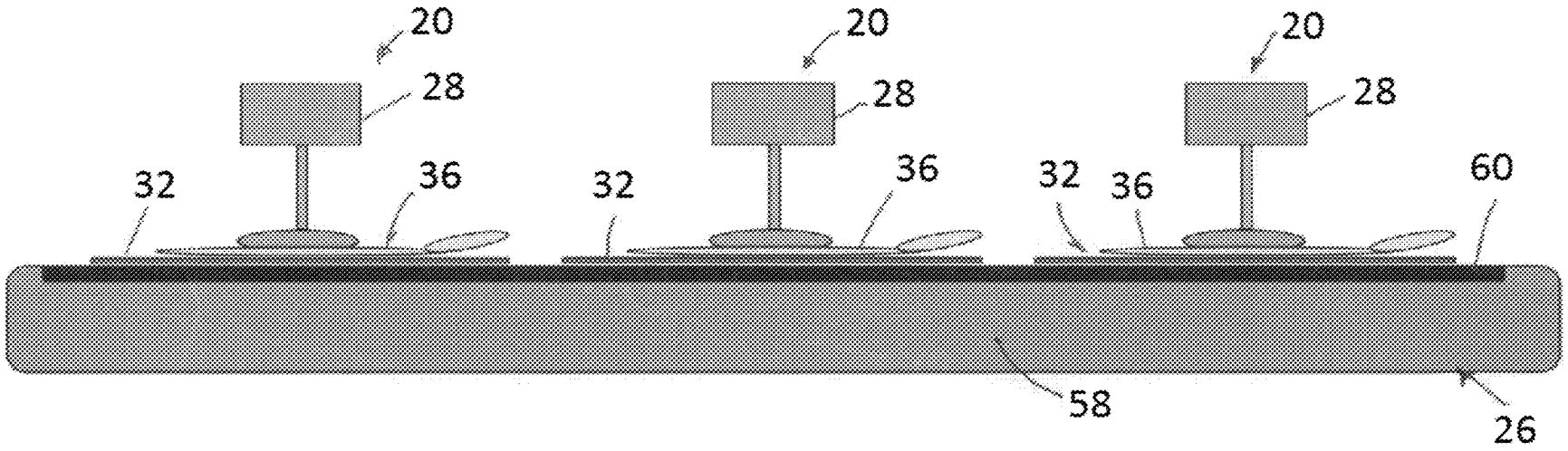
FIG. 5 is a schematic side view of the system of FIG. 1 including a floating magnetic table.

FIG. 5 illustrates the system 20 of FIG. 1 applied to multiple place settings on the table 26. The table 26 includes a table top 58 including an inlaid, embedded or attached ferromagnetic layer, such as a layer 60 composed of steel or iron. Each supported body 32 is magnetically attached to the table 26, particularly to the layer 60. The table 26 can be a traditional table or a portable table, such as a lap table, a floating table, or other kind of support. In the case of a floating table, the table table top 58 can be composed of foam, balsa wood, Styrofoam, wood, polystyrene or other buoyant material.

Alternatively, the layer 60 in the table top 58 can be a magnetic layer and the magnetic component 50 can be magnetic or ferromagnetic to be attracted to the layer 60. If the layer 60 is magnetic it can be a flat relatively thin magnetized iron or steel sheet material or of a non-magnetic synthetic resinous plastic such as polystyrene, polypropylene, acrylic, or the like, having finely divided magnetic particles distributed throughout the layer 60. Alternatively, the magnetic layer 60 can be formed by a magnetic coating applied to a similar non-magnetic body.

Figure 6:
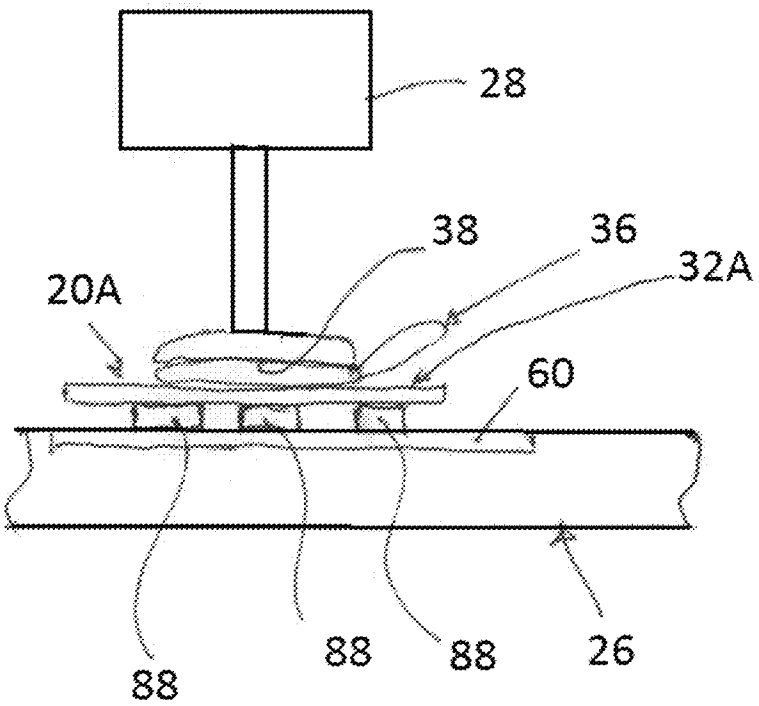
FIG. 6 is a schematic side view of an alternate system according to the invention.

FIG. 6 shows an alternate embodiment system 20A wherein the supported body 32A has a plurality of individual magnets 88 to hold the support body to the layer 60 of the table 26. The alternate supported body 32A can be otherwise as described above for the supported body 32.

Figure 7:
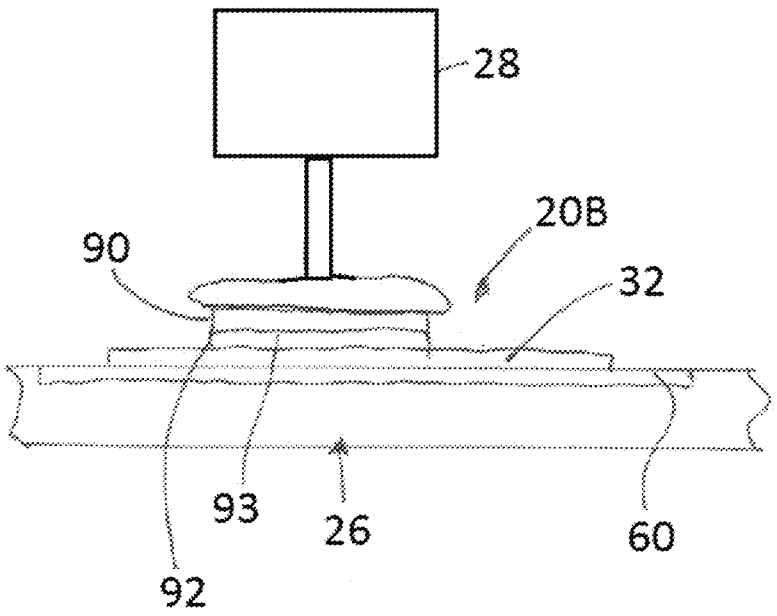
FIG. 7 is a schematic side view of a further alternate system according to the invention.

FIG. 7 shows a further alternate embodiment system 20B wherein the adhering component comprises a cooperating pair of hook and loop tapes 90, 92 that are adhesively secured to the respective tableware or dishware 28 and supported body 32 and are separable along a parting plane 93 to separate the tableware or dishware 28 from the supported body 32. The supported body 32 is otherwise the same as described above.

Figure 8:
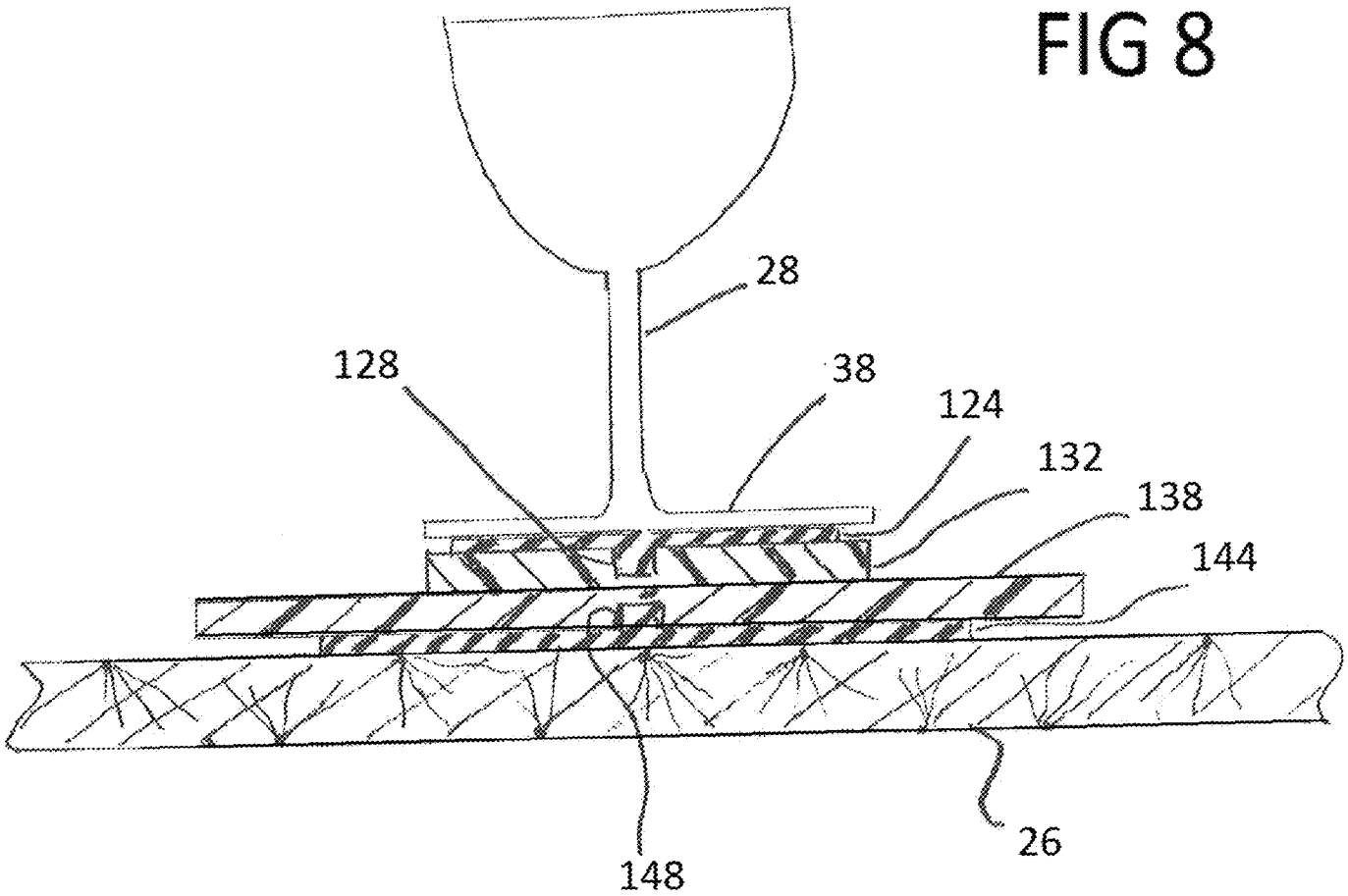
FIG. 8 is a sectional view of an alternate embodiment system according to the invention.
Figure 9:
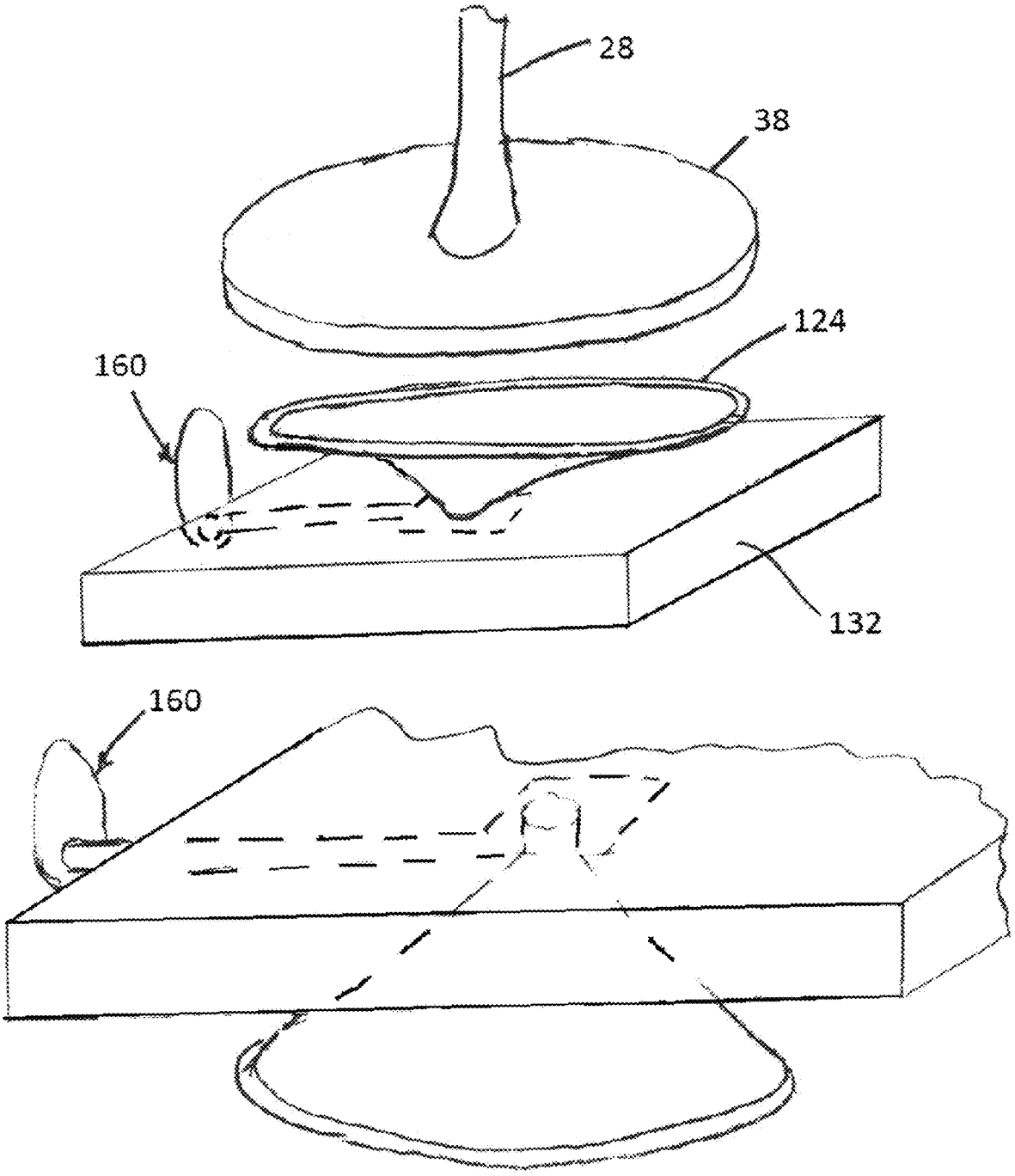
FIG. 9 is an exploded perspective view of the system according to FIG. 8.
Figure 10:
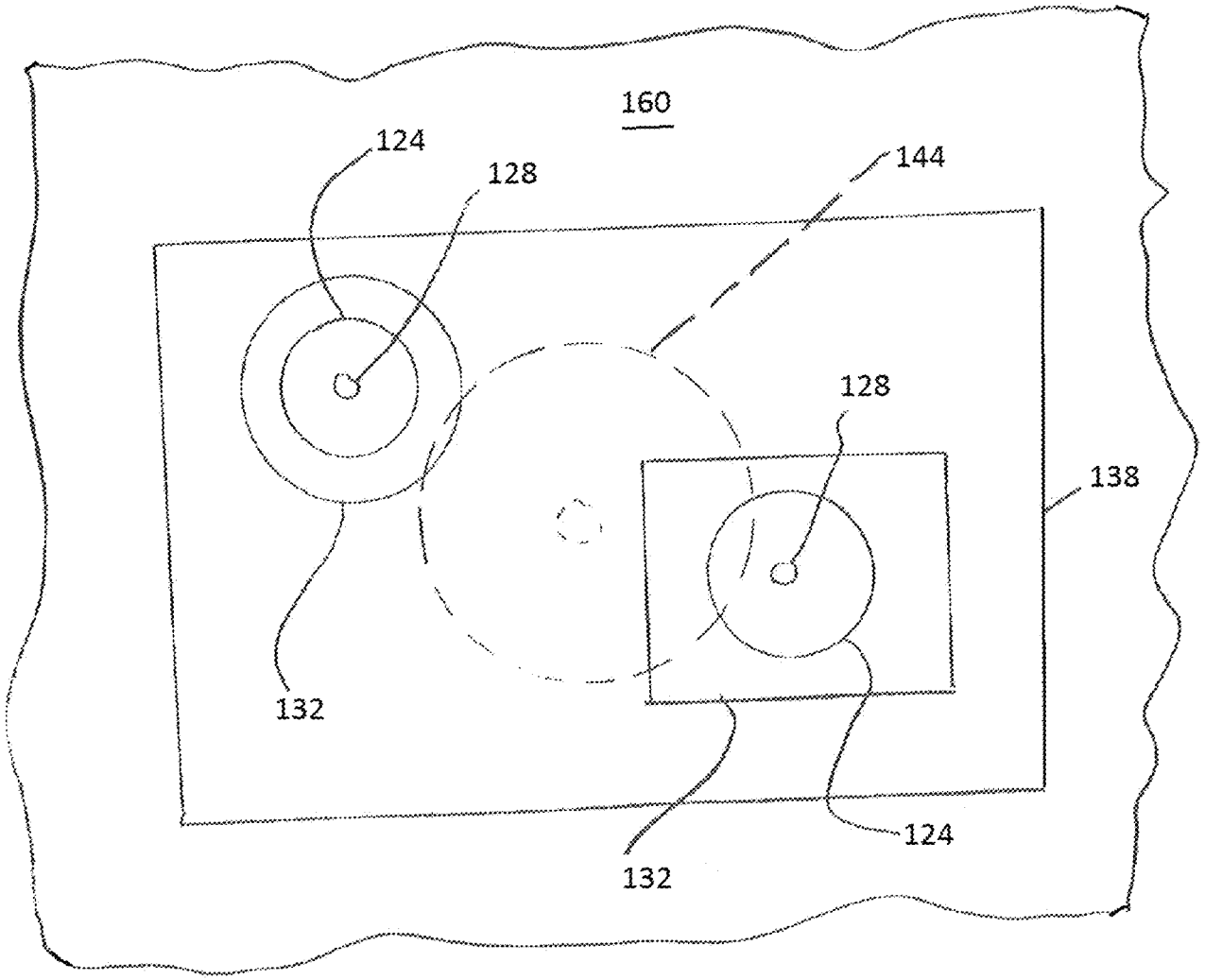
FIG. 10 is a plan view of the system of FIG. 8.

FIGS. 8-10 illustrate an alternate system 100 for holding tableware or dishware, such as the stemware 28, to a support surface, such as the table 26. For this system 100, the table 26 need not have a ferromagnetic or magnetic plate 60.

The base 38 of the stemware 28 is releasably attached to a first attaching device, such as a first suction cup 124. The suction cup is attached at its apex 128 to a supported body 132. The supported body 132 is composed of ferromagnetic or magnetic material. The supported body can be a plate that is square, round or any shape. The supported body can be rigid or flexible. Although a single suction cup is shown, multiple, smaller suction cups could be used as well.

The supported body is magnetically attached to a support body 138. The support body 138 is composed of ferromagnetic or magnetic material. The supported body can be a plate that is square round or any shape. The supported body can be rigid or flexible. The material of the supported body and the support body is selected to achieve a magnetic attraction there between. The support body 138 is attached to a second attaching device, such as a second suction cup 144. The support body 138 is attached to the second suction cup at its apex 148. The second suction cup 144 can releasably attach the support body to the support surface, such as a table 26. Although a single suction cup is shown, multiple, smaller suction cups could be used as well.

As shown in FIG. 9, each suction cup can have an effective release mechanism 160 to release the suction on the suction cup to remove either the support body 138 from the support surface of the supported body 132 from the tableware or dishware. The release mechanism is shown schematically but could be configured as described in one of the following US patents, hereby incorporated by reference to the extend not inconsistent with the present disclosure: U.S. Pat. Nos. 9,057,398; 8,387,932; 8,066,238; 5,176,357; 5,405,112; 7,850,133; 7,878,467; 8,348,216.

According to other embodiments, the suction cups 124, 144 can be replaced by stretch-releasable pressure sensitive adhesive such as described in U.S. Pat. Nos. 4,024,312 and 5,516,581; and sold commercially as COMMAND by 3M Company, St. Paul, Minn., U.S., all of which are hereby incorporated by reference to the extent they are not inconsistent with the present disclosure.

Alternately, the suction cups can be replaced by GECKO type releasable adhesive fasteners such as described in published US patent applications US2016/0375654; US2016/0102804; US2016/0333228; US2014/0312188; and U.S. Pat. Nos. 9,603,419; 9,574,113; 9,440,416; 9,395,038 or 9,182,075, all hereby incorporated by reference to the extent they are not inconsistent with the present disclosure.

As shown in FIG. 10, the support body 138 can be larger than the supported body 132, such as embodied as a placemat holding multiple supported bodies each holding a piece of tableware or dishware such as dishes and drinking glasses (not shown).

The embodiment of FIGS. 8-10 allows for a magnetic tableware of dishware holding system that is compatible with existing non-metallic support surfaces.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. A system for adhering tableware or dishware to a support surface, comprising:

a supported body having a magnetic component;

a support surface having a ferromagnetic component, wherein when in use, the magnetic component is adhered to the ferromagnetic component by magnetic attraction;

a reusable adhering component arranged on the supported body on a top surface thereof, arranged to adhere a piece of table ware or dishware onto the supported body.

2. The system according to claim 1, wherein the magnetic component comprises a planar article having magnetic particles within the planar article.

3. The system according to claim 1, wherein the magnetic component comprise one or more magnets.

4. The system according to claim 1, wherein the adhering component comprises a stretch releasable pressure adhesive tape.

5. The system according to claim 1, wherein the adhering component comprises a double sided adhesive tape.

6. The system according to claim 1, wherein the adhering component comprises a hook and loop fastener with cooperating surfaces adhered to the supported body and the tableware or dishware.

7. The system according to claim 1, wherein the support surface is provided on a table.

8. The system according to claim 1, wherein the support surface is provided on a floating table.

9. The system according to claim 1, wherein the support surface is provided on a placemat.

10. The system according to claim 1, wherein the supported body comprises a flexible matt.

11. The system according to claim 1, wherein the supported body comprises a rigid plate.

12. A system for adhering tableware or dishware to a table, comprising:

a supported body having a first magnetic or ferromagnetic component, and a first releasable attaching device on a top surface thereof;

a support body having a second magnetic or ferromagnetic component, and a second releasable attaching device on a bottom surface thereof;

the first releasable attaching device arranged to be attached to a piece of tableware or dishware and the second releasable attaching device arranged to be attached to a support surface, with the first and second magnetic or ferromagnetic components in a facing relationship to be attached by magnetic attraction.

13. The system according to claim 12, wherein the first magnetic or ferromagnetic component comprises a planar article having magnetic particles within the planar article.

14. The system according to claim 12, wherein the first magnetic or ferromagnetic component comprises one or more magnets.

15. The system according to claim 12, wherein the second releasable attaching device comprises a suction cup.

16. The system according to claim 12, wherein the first releasable attaching device comprises a suction cup.

17. The system according to claim 12, wherein the first releasable attaching device comprises a double sided adhesive tape.

18. The system according to claim 12, wherein the second releasable attaching device comprises a double sided adhesive tape.

19. The system according to claim 12, wherein the support surface is provided on a floating table.

20. The system according to claim 12, wherein the support surface is provided on a table.

21. The system according to claim 12, wherein the support body comprises a flexible matt.

22. The system according to claim 12, wherein the support body comprises a rigid plate.

* * * * *